US007416386B2

(12) United States Patent
Ho et al.

(10) Patent No.: US 7,416,386 B2
(45) Date of Patent: Aug. 26, 2008

(54) HEAT DISSIPATION APPARATUS

(75) Inventors: Shih-Hua Ho, Taoyuan Hsien (TW); Hao-Ming Chen, Taoyuan Hsien (TW); Tsung-Yu Lei, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/699,009

(22) Filed: Jan. 29, 2007

(65) Prior Publication Data

US 2007/0122278 A1 May 31, 2007

Related U.S. Application Data

(63) Continuation-in-part of application No. 11/230,450, filed on Sep. 21, 2005, now abandoned.

(51) Int. Cl.
*F04D 29/54* (2006.01)

(52) U.S. Cl. ..... 415/208.5; 415/119; 415/207; 415/208.2; 415/208.3; 415/211.2; 415/220; 415/222; 415/223; 416/228; 416/236 R; 416/237; 417/354; 417/423.14; 361/695

(58) Field of Classification Search ..... 415/119, 415/207, 208.1, 208.2, 208.3, 211.1, 211.2, 415/220, 222–223, 175–178, 173.1, 173.5, 415/208.5; 416/189, 191–192, 228, 235, 416/236 R, 237; 417/354, 423.14; 361/695–697
See application file for complete search history.

(56) References Cited

U.S. PATENT DOCUMENTS

| | | | | |
|---|---|---|---|---|
| 3,334,807 A | | 8/1967 | McMahan | |
| 4,061,188 A | | 12/1977 | Beck | |
| 4,221,546 A | * | 9/1980 | Papst et al. | 417/354 |
| 4,225,285 A | | 9/1980 | Sturm et al. | |
| 4,482,302 A | | 11/1984 | Grignon et al. | |
| 5,788,566 A | | 8/1998 | McAnally et al. | |
| 6,024,537 A | * | 2/2000 | Moreau et al. | 416/192 |
| 6,132,171 A | | 10/2000 | Fujinaka et al. | |
| 6,450,760 B1 | * | 9/2002 | Furukawa et al. | 415/119 |
| 6,707,669 B2 | | 3/2004 | Lee et al. | |
| 6,874,990 B2 | * | 4/2005 | Nadeau | 415/173.5 |
| 7,110,255 B2 | * | 9/2006 | Ko et al. | 361/695 |
| 2003/0161728 A1 | * | 8/2003 | Cho et al. | 415/222 |
| 2006/0216147 A1 | * | 9/2006 | Park | 415/220 |

FOREIGN PATENT DOCUMENTS

| | | | | |
|---|---|---|---|---|
| JP | 59-168300 A | * | 9/1984 | 415/211.2 |
| JP | 1-315697 A | * | 12/1989 | 416/228 |
| JP | 6-81799 A | | 3/1994 | |

* cited by examiner

*Primary Examiner*—Christopher Verdier
(74) *Attorney, Agent, or Firm*—Birch, Stewart, Kolasch & Birch, LLP

(57) ABSTRACT

A heat dissipation apparatus. A fan frame includes an air inlet, an air outlet, a passage, and a curved expansion portion. The air inlet is opposite the air outlet. The passage is between the air inlet and the air outlet, guiding airflow from the air inlet to the air outlet. The curved expansion portion is radially and outwardly extended from an inner peripheral wall of the passage at the air inlet or air outlet. An impeller is disposed in the fan frame and includes a plurality of blades. Each blade is disposed in the passage and includes an extension end extending to the curved expansion portion.

17 Claims, 16 Drawing Sheets

HEAT DISSIPATION APPARATUS

CROSS REFERENCE TO RELATED APPLICATIONS

This application is a Continuation-In-Part of U.S. patent application Ser. No. 11/230,450, filed Sep. 21, 2005 and entitled "HEAT DISSIPATION APPARATUS AND FAN FRAME THEREOF", which is now abandoned, for which priority is claimed under 35 U.S.C. § 129.

BACKGROUND OF THE INVENTION

1. Field of the Invention

The invention relates to a heat dissipation apparatus, and more particularly to a heat dissipation apparatus providing reduced noise.

2. Description of the Related Art

As performance of electronic devices is promoted, heat dissipation apparatuses or systems are indispensable and thus used in the electronic devices. If heat generated by an electronic device is not efficiently dissipated, performance of the electronic device may deteriorate or the electronic device may be damaged.

Fans serve widely as heat dissipation apparatuses. FIG. 1A is a schematic view of a conventional fan 1, and FIG. 1B is a schematic cross section taken along A-A' of FIG. 1A. The conventional fan 1 is composed of a fan frame 11 and an impeller 12. When the fan 1 operates, the impeller 12 is activated by a motor 13, providing airflow to a heat source (such as a heat-generating electronic device, not shown) and thus dissipating heat therefrom. The fan frame 11 has a through hole forming an air inlet 112 and an air outlet 114 on two ends of the fan frame 11, respectively. The air inlet 112 is connected to the air outlet 114 by way of a central passage 116, such that the airflow provided by the impeller 12 can freely pass the air inlet 112 and air outlet 114. Additionally, four threaded holes 14 are formed on the corners of the fan frame 11, by means of which the fan 1 can be fixed to the shell of a system having electronic devices, such as a computer.

FIGS. 1C, 1E, and 1F are schematic cross sections of conventional fans and fan frames. A bevel angle C (as shown in FIG. 1C) or a tapered angle D (as shown in FIG. 1E) is formed near the air inlet 112 or air outlet 114 of the fan frame 11 in order to increase the area through which the airflow passes. As shown in FIG. 1D, although the bevel angle C increases the area of the air outlet 114, output airflow cannot be concentrated, thus reducing the airflow pressure provided by the fan frame 11. Alternatively, a recessed opening E (as shown in FIG. 1F) is formed near the air outlet 114 of the fan frame 11, increasing the area through which the airflow passes. However, the airflow is easily dispersed from the recessed opening E.

Conventionally, when airflow passes through the air outlet 114, the airflow directly contacts the periphery of the inner wall of the central passage 116 (as shown in FIG. 1B), bevel angle C, tapered angle D, or wall of the recessed opening E. Accordingly, the airflow can not pass through the air outlet 114 smoothly and is slowed. Also, noise is generated by friction between airflow and the inner peripheral wall of the central passage 116. Specifically, the higher the rotational speed of the fan, the more the noise generated thereby.

BRIEF SUMMARY OF THE INVENTION

Hence, the invention provides a heat dissipation apparatus (a fan) and a fan frame thereof. The fan and fan frame have a smooth curved expansion portion capable of reducing noise generated by friction between airflow and the inner peripheral wall of a passage, stabilizing and concentrating the airflow, and enhancing performance of the fan. Moreover, the inner peripheral wall of the fan frame outwardly extends, increasing areas of air intake or discharge, concentrating the airflow, and enhancing performance of the fan. Further, the fan is easily applied to a heat dissipation system or any other electronic devices which generate heat by assembling without modifying arrangement of the system.

An exemplary embodiment of the invention provides a heat dissipation apparatus comprising a fan frame and an impeller. The fan frame comprises an air inlet, an air outlet, a passage, and a curved expansion portion. The air inlet is opposite the air outlet. The passage is between the air inlet and the air outlet, guiding airflow from the air inlet to the air outlet. The curved expansion portion is radially and outwardly extended from an inner peripheral wall of the passage at the air inlet or air outlet. The impeller is disposed in the fan frame and comprises a plurality of blades. Each blade is disposed in the passage and comprises an extension end extending to the curved expansion portion.

The profile of the extension end corresponds to that of the curved expansion portion.

The curvature of the extension end corresponds to that of the curved expansion portion.

The extension end is configured with a curved angle, an acute angle, an obtuse angle, or a bevel angle.

The fan frame further comprises at least one curved concave formed in the curved expansion portion, providing stabilization functions to the airflow.

The curved expansion portion further comprises a recess in which the airflow forms an airflow layer, stopping subsequent airflow from directly contacting the inner peripheral wall of the passage.

The fan frame further comprises another curved expansion portion radially and outwardly extended from the inner peripheral wall of the passage at the air inlet or air outlet. The other curved expansion portion is symmetrical to the curved expansion portion with respect to a central axis of the passage.

The heat dissipation apparatus further comprises a motor base disposed in the fan frame. The impeller is disposed on the motor base, and the motor base comprises a slope inclined radially. The slope is flat.

Another exemplary embodiment of the invention provides a heat dissipation system comprising a system housing, at least one electronic device, and a heat dissipation apparatus. The at least one electronic device is disposed in the system housing. The heat dissipation apparatus is applied to the system housing for dissipating heat generated by the at least one electronic device. The heat dissipation apparatus comprises a fan frame and an impeller. The fan frame comprises an air inlet, an air outlet, a passage, and a curved expansion portion. The air inlet is opposite the air outlet. The passage is between the air inlet and the air outlet, guiding airflow from the air inlet to the air outlet. The curved expansion portion is radially and outwardly extended from an inner peripheral wall of the passage at the air inlet or air outlet. The impeller is disposed in the fan frame and comprises a plurality of blades. Each blade is disposed in the passage and comprises an extension end extending to the curved expansion portion.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 2A:
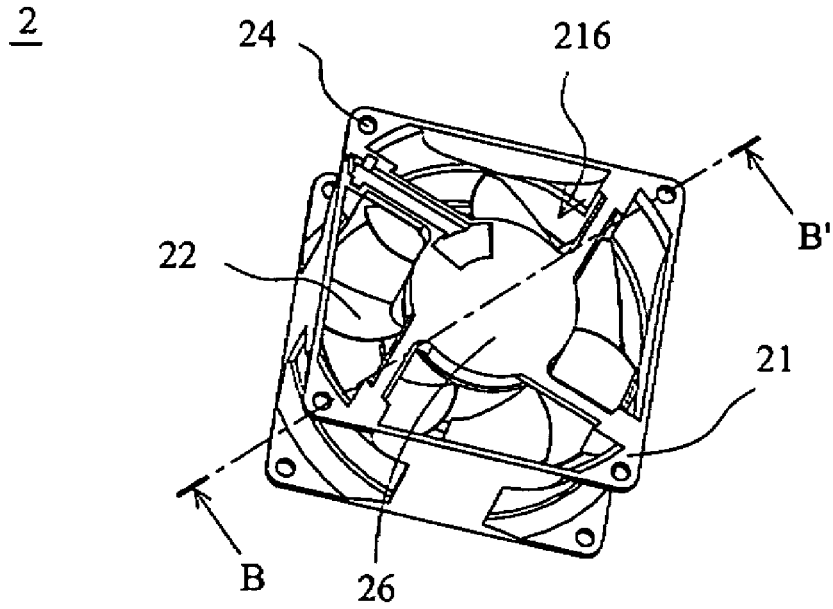
FIG. 2A is a schematic view of a fan of an embodiment of the invention.
Figure 2B:
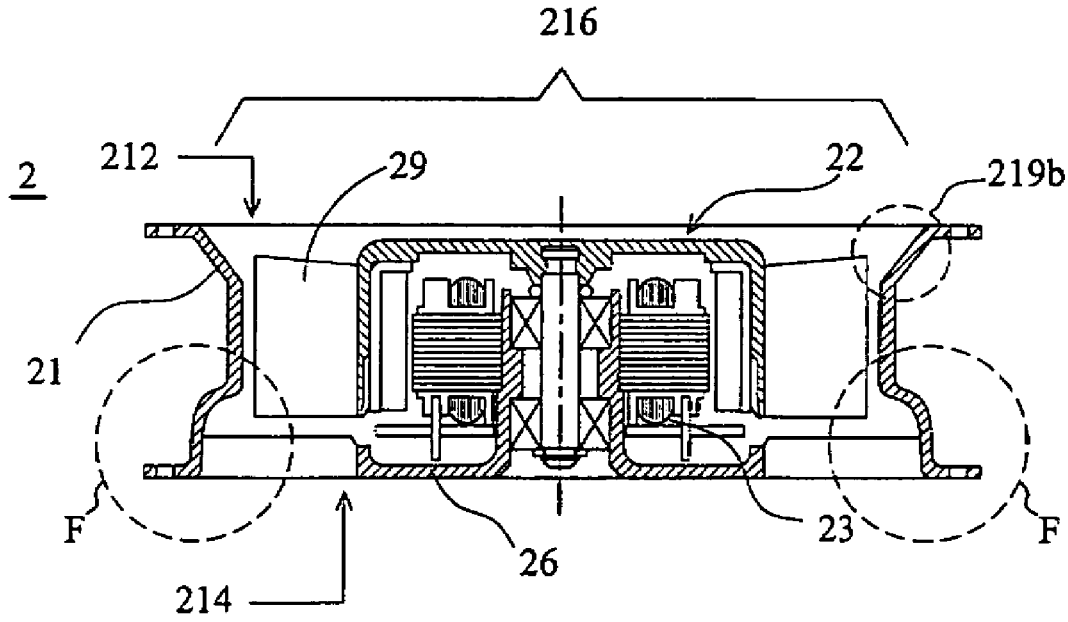
FIG. 2B is a schematic cross section taken along B-B' of FIG. 2A.

Referring both to FIG. 2A and FIG. 2B, the heat dissipation apparatus 2 can be, for example, an axial flow fan and has a fan frame 21, an impeller 22, and a motor base 26. The fan frame 21 may be a substantially rectangular, circular, elliptical, or rhomboid casing. The fan frame 21 has a through hole so as to form a passage 216 therein, an air inlet 212, and an air outlet 214. The air inlet 212 is connected to the air outlet 214 by way of the passage 216. The passage 216 can guide airflow from one opening (air inlet 212) to the other opening (air outlet 214). Airflow generated by the impeller 22 can thus enter and leave the fan frame 21. Additionally, multiple threaded holes 24 are formed on corners of the fan frame 21 so that the fan 2 can be fixed to a housing of an electronic system, such as a computer.

The fan frame 21 accommodates the impeller 22, and the motor base 26 is disposed in the fan frame 21. The impeller 22 is disposed on the motor base 26. When the fan 2 operates, a motor 23 disposed on the motor base 26 activates the impeller 22 so as to provide airflow to an electronic device (not shown) and to dissipate the heat generated by the electronic device.

Figure 1A:
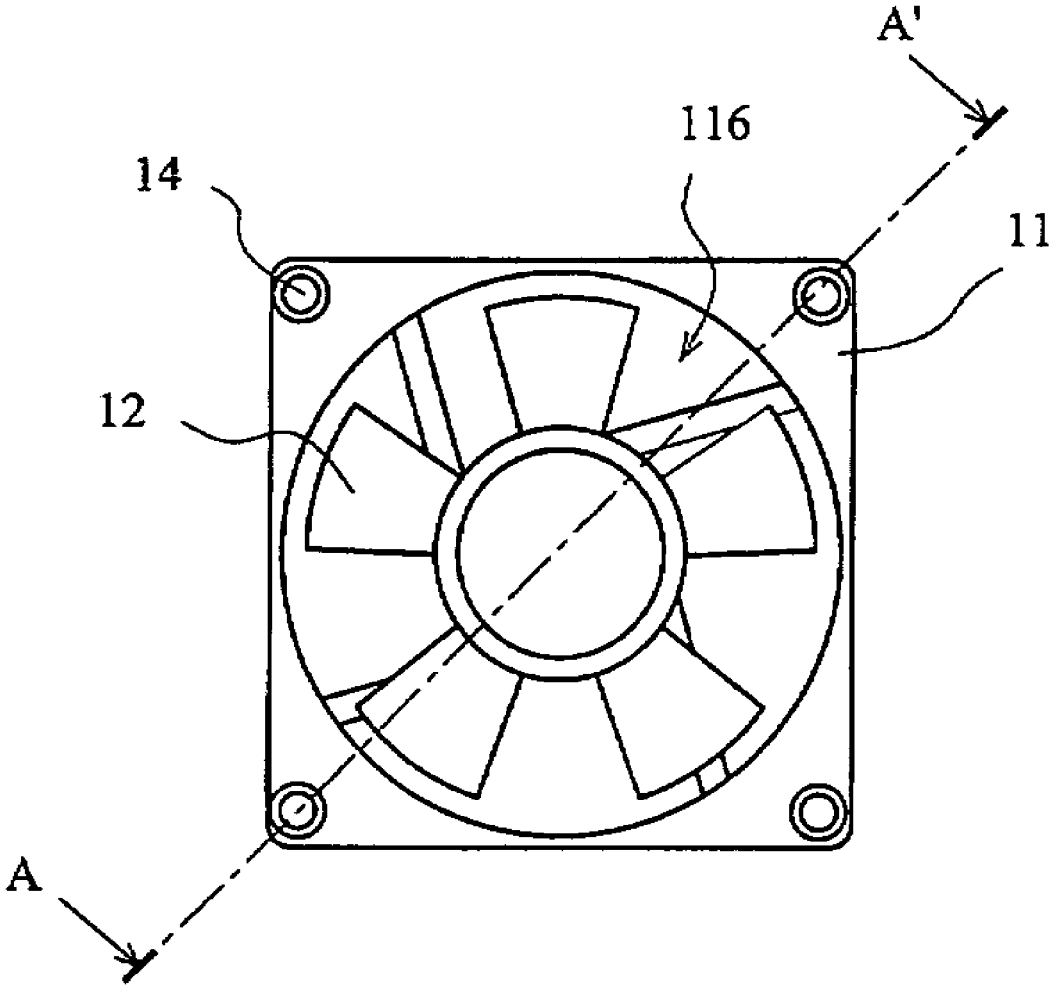
FIG. 1A( PRIOR ART )
FIG. 1A is a schematic view of a conventional fan.
Figure 1B:
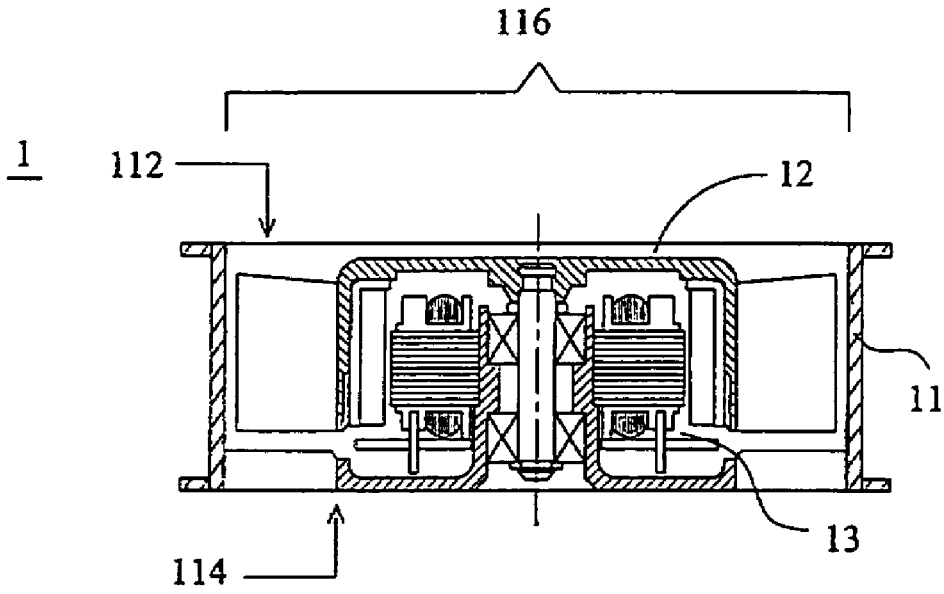
FIG. 1B ( PRIOR ART )
FIG. 1B is a schematic cross section taken along A-A' of FIG. 1A.
Figure 1C:
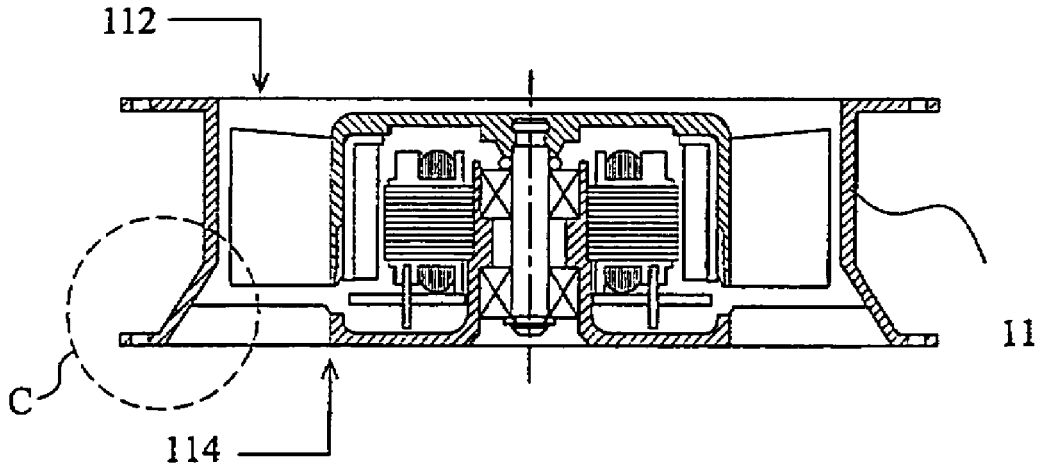
FIG. 1C ( PRIOR ART )
FIGS. 1C, 1E, and 1F are schematic cross sections of conventional fan frames.
Figure 1D:
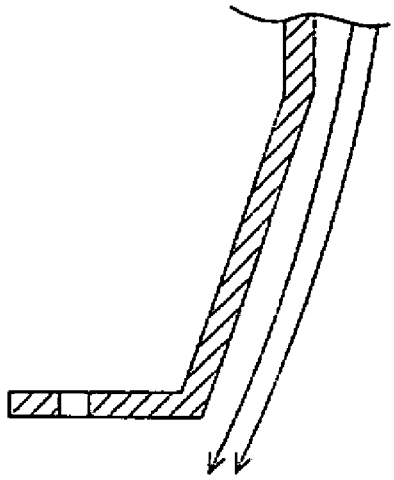
FIG. 1D( PRIOR ART )
FIG. 1D is a schematic view showing the direction of air flow in the fan frame of FIG. 1C.
Figure 1E:
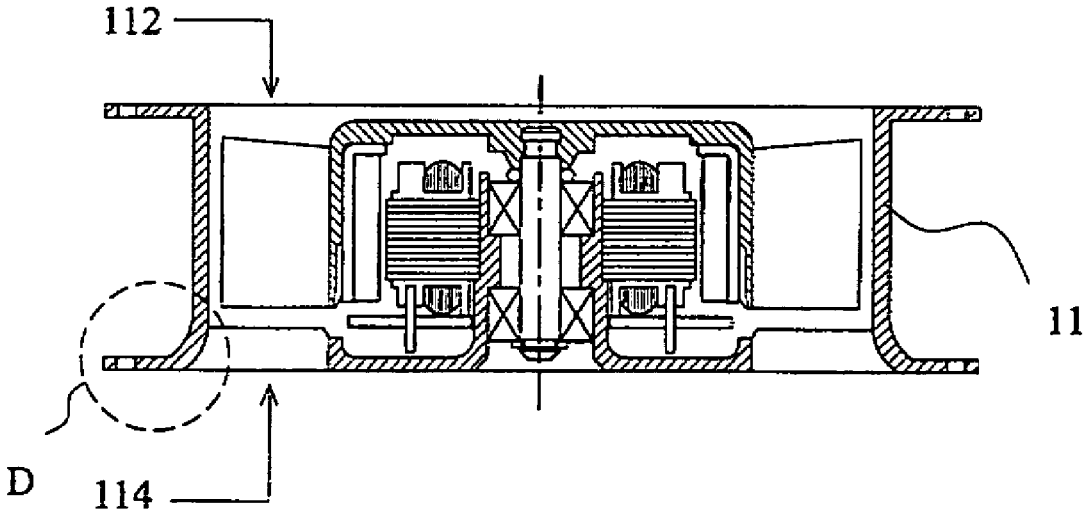
FIG. 1E ( PRIOR ART )
Figure 1F:
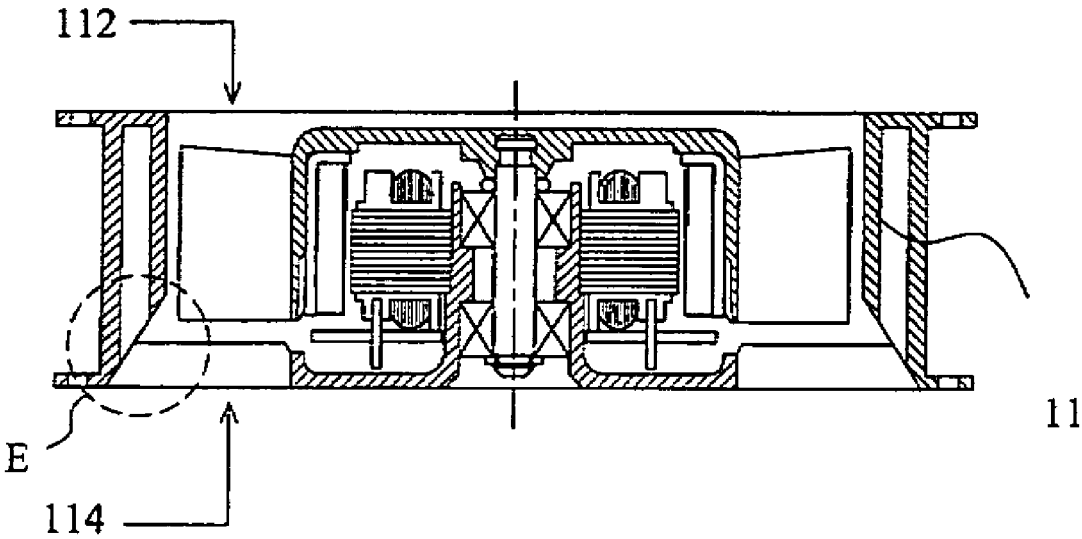
FIG. 1F ( PRIOR ART )
Figure 3A:
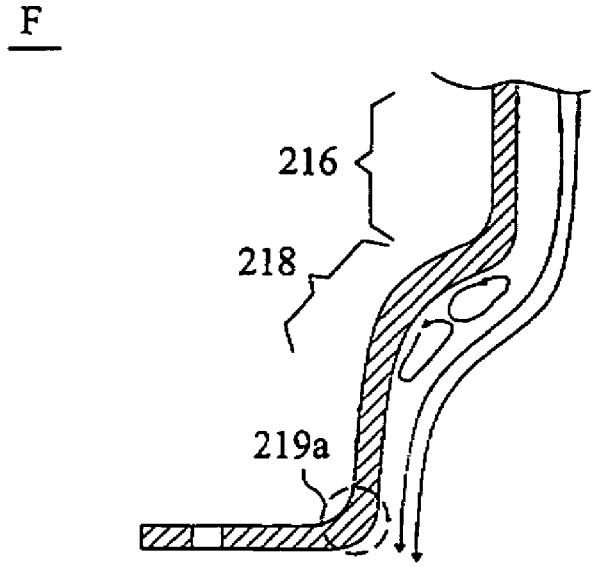
FIG. 3A is a schematic view showing the curved expansion portion F of FIG. 2B and the direction of air flow near the curved expansion portion F.

Referring to FIG. 2B and FIG. 3A, an inner peripheral wall of the passage 216 radially and outwardly extends a smooth curved expansion portion F at the air outlet 214. The curved expansion portion F includes a recess 218 in which the airflow forms an airflow layer so as to stop subsequent airflow from directly contacting the inner peripheral wall of the passage 216. Specifically, the airflow in the recess 218 provides an air cushion, thereby stopping subsequent airflow from directly contacting the frame wall of the fan frame 21. Accordingly, friction between air and solid is changed to friction between air and air, and noise is thus reduced. Moreover, the recess 218 of the curved expansion portion F provides sufficient space for airflow, thus stabilizing the airflow. Additionally, when the airflow passes through the air outlet 214, the curved expansion portion F can sufficiently concentrate the airflow and enhance air pressure compared to the conventional fan frame 11 (FIG. 1D).

The curved expansion portion F is symmetrical with respect to the axis of the passage 216. Also, another curved expansion portion may be radially and outwardly extended from the inner peripheral wall of the passage 216 at the air inlet 212. Moreover, the length of blades 29 of the impeller 22 matches the fan frame 21 and extends towards the radially and outwardly extended curved expansion portion F so as to increase air volume. Preferably, the curved expansion portion F at the air outlet 214 may be formed with a tapered angle 219*a* (FIG. 3A) or a bevel angle, so as to allow the airflow more smoothly passing through the fan frame 21.

Additionally, the inner peripheral wall of the fan frame 21 at the air inlet 212 may be formed with a bevel angle 219*b* (FIG. 2B) or a tapered angle, increasing the area of the air inlet 212. Alternatively, the inner peripheral wall of the passage 216 at the air inlet 212 is radially and outwardly extended out of the fan frame 21 in a circular or elliptical shape and is symmetrical with respect to the axis of the passage 216.

Moreover, the curved expansion portion F may be radially and outwardly extended out of the fan frame 21 with respect to the axis of the passage 216 so as to increase the area through which the airflow passes.

Figure 3B:
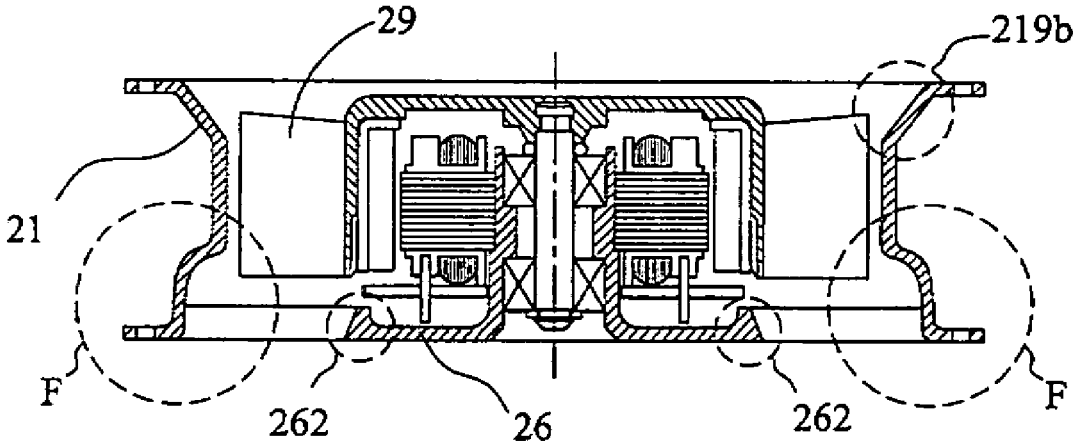
FIG. 3B is a schematic cross section of another fan frame of the invention.

FIG. 3B shows another fan frame of an embodiment of the invention. As mentioned above, the present invention discloses the curved expansion portion F with a tapered angle at the air inlet 212 and/or air outlet 214, and the motor base 26 may additionally include a slope 262 radially inclined. The slope 262 is flat.

Figure 4:
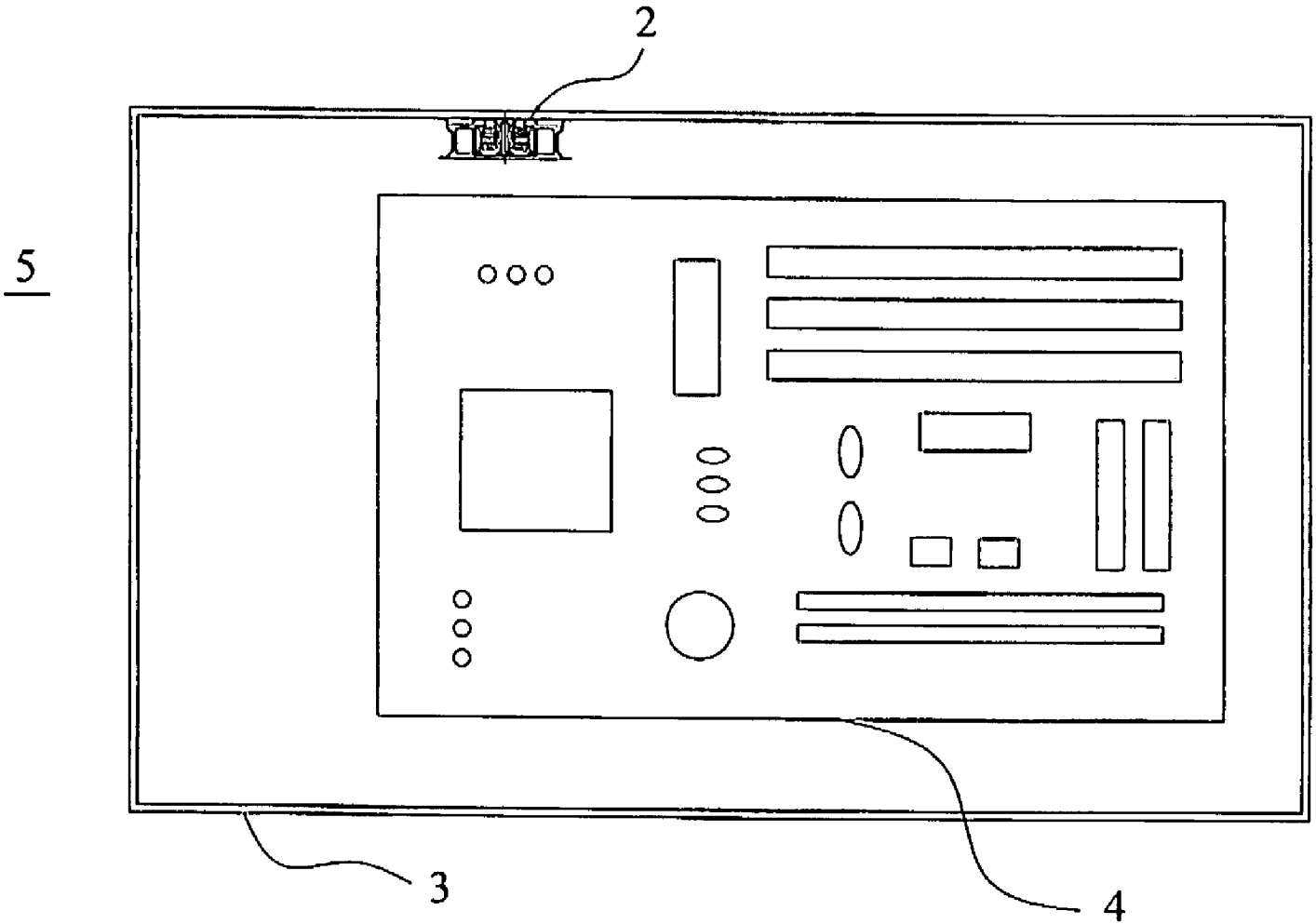
FIG. 4 is a schematic view showing that a heat dissipation apparatus of the invention is applied to a system having electronic devices.

In practical application, the heat dissipation apparatus 2 can be applied to a heat dissipation system 5 which includes a system housing 3 and multiple electronic devices, as shown in FIG. 4. Inside the system housing 3, the electronic devices or heat sources are mostly on a circuit board 4, and the heat dissipation apparatus 2 is disposed in a suitable position of the system housing 3, such that cold airflow generated by the heat dissipation apparatus 2 is provided during operation of the electronic devices or heat sources. Accordingly, heat generated by the electronic devices is efficiently dissipated, and damage of the electronic devices is thus prevented due to high temperature.

Figure 5A:
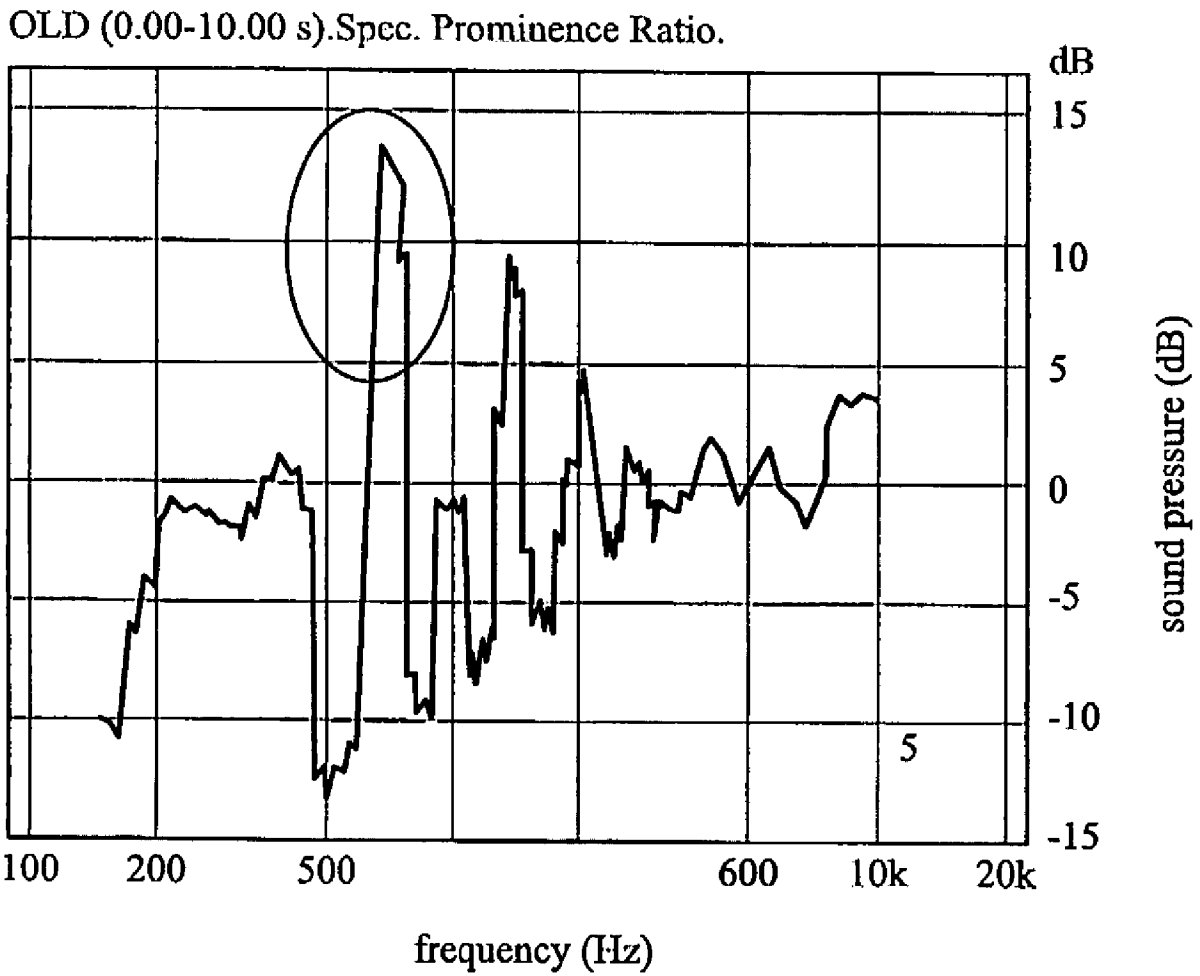
FIG. 5A and FIG. 5B are diagrams showing audio comparison of the conventional and present fans.
Figure 5B:
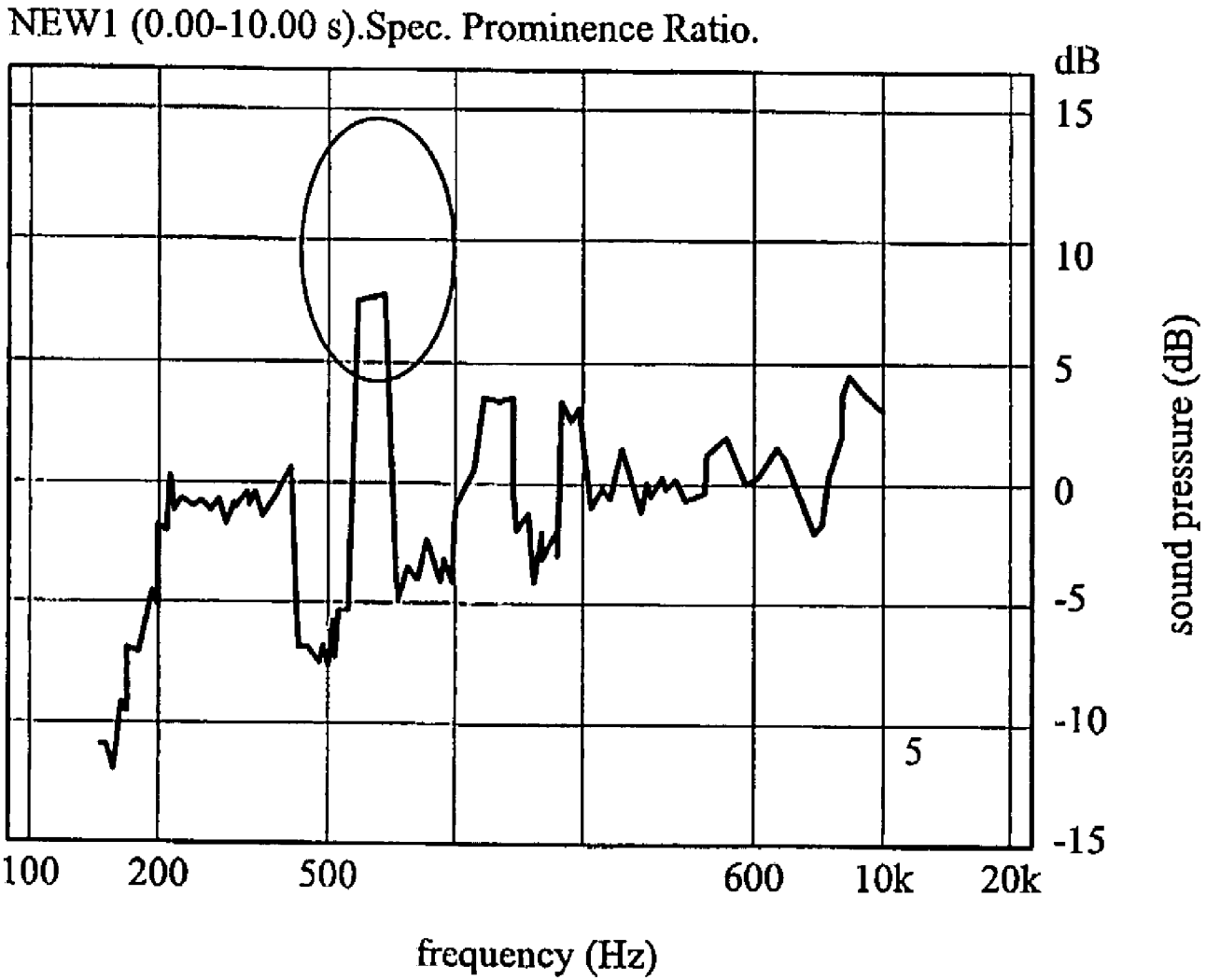

FIG. 5A is a diagram showing results of audio testing of a conventional fan. FIG. 5B is a diagram showing results of audio testing of the present fan. Both the conventional and present fans have a diameter of approximate 8 cm and were tested at speed of 5700 rpm. Comparing the results shown in FIG. 5A and FIG. 5B, the conventional fan incurs obvious noise at a frequency of 665 Hz during operation while the present fan does not.

Figure 6A:
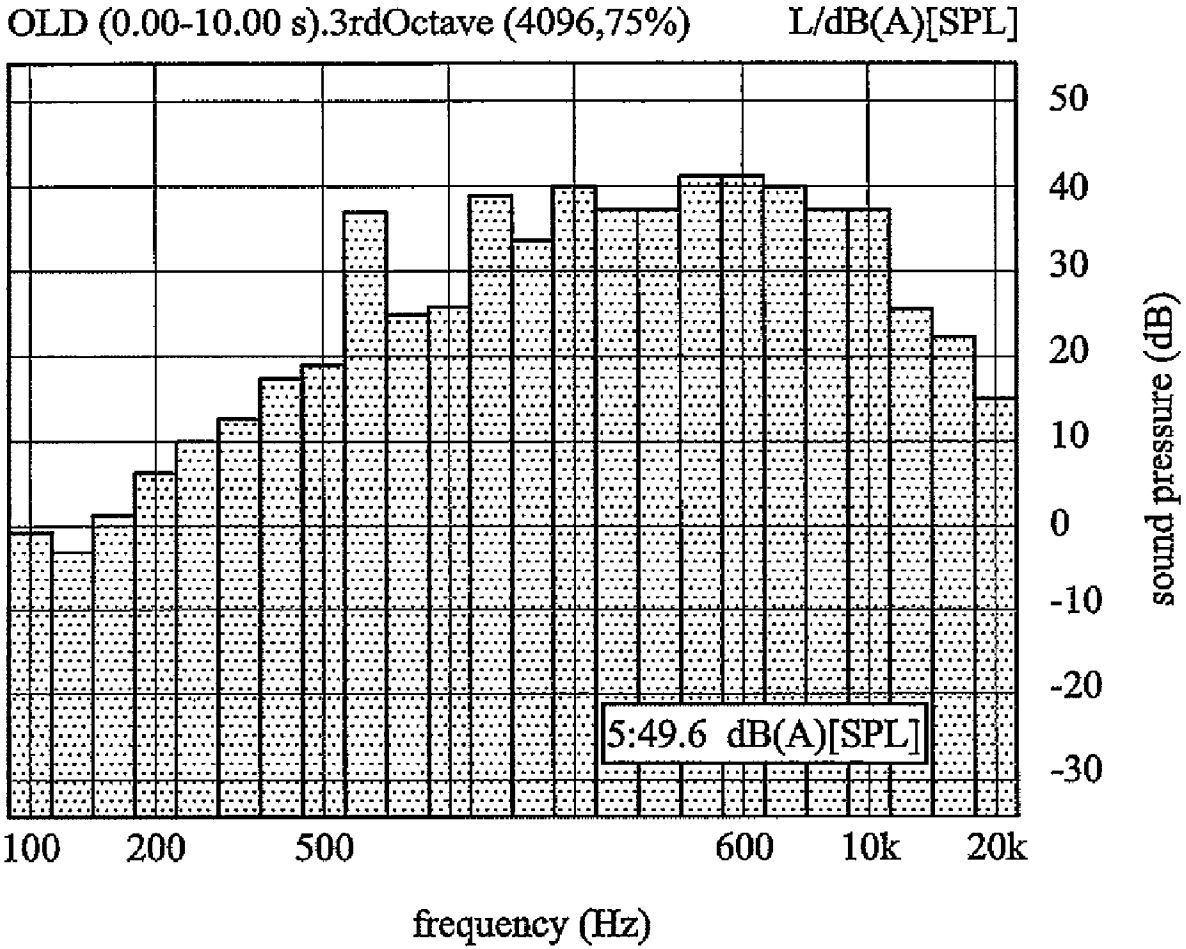
FIG. 6A and FIG. 6B are diagrams showing volume comparison of the conventional and present fans.
Figure 6B:
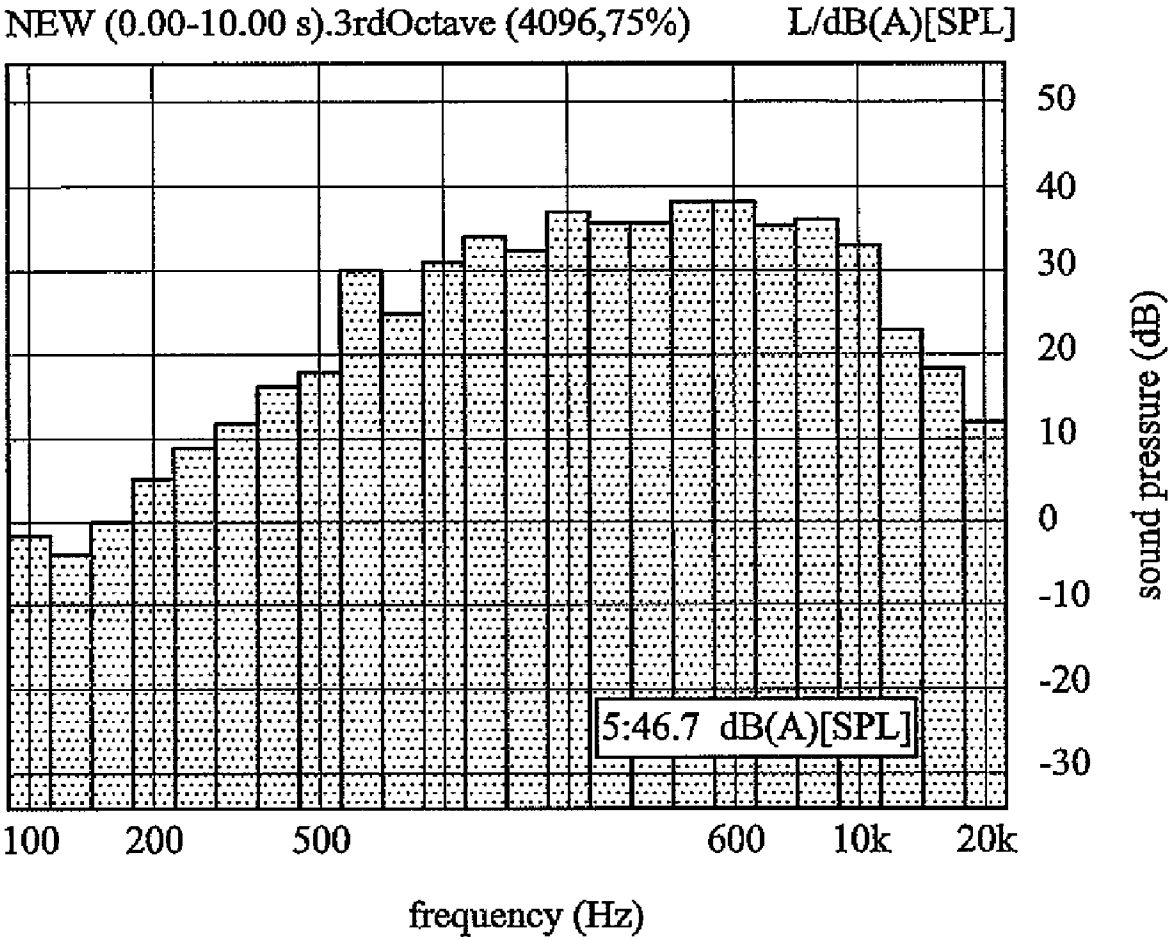

FIG. 6A is a diagram showing results of volume testing of a conventional fan. FIG. 6B is a diagram showing results of volume testing of the present fan. Both the conventional and present fans have a diameter of approximate 8 cm and were tested at speed of 5700 rpm. As shown in FIG. 6A, the noise value of the conventional fan at speed of 5700 rpm is 49.6 dB. As shown in FIG. 6B, the noise value of the present fan at the same speed is 46.7 dB. Accordingly, the present fan can effectively reduce noise compared to the conventional fan.

Figure 7:
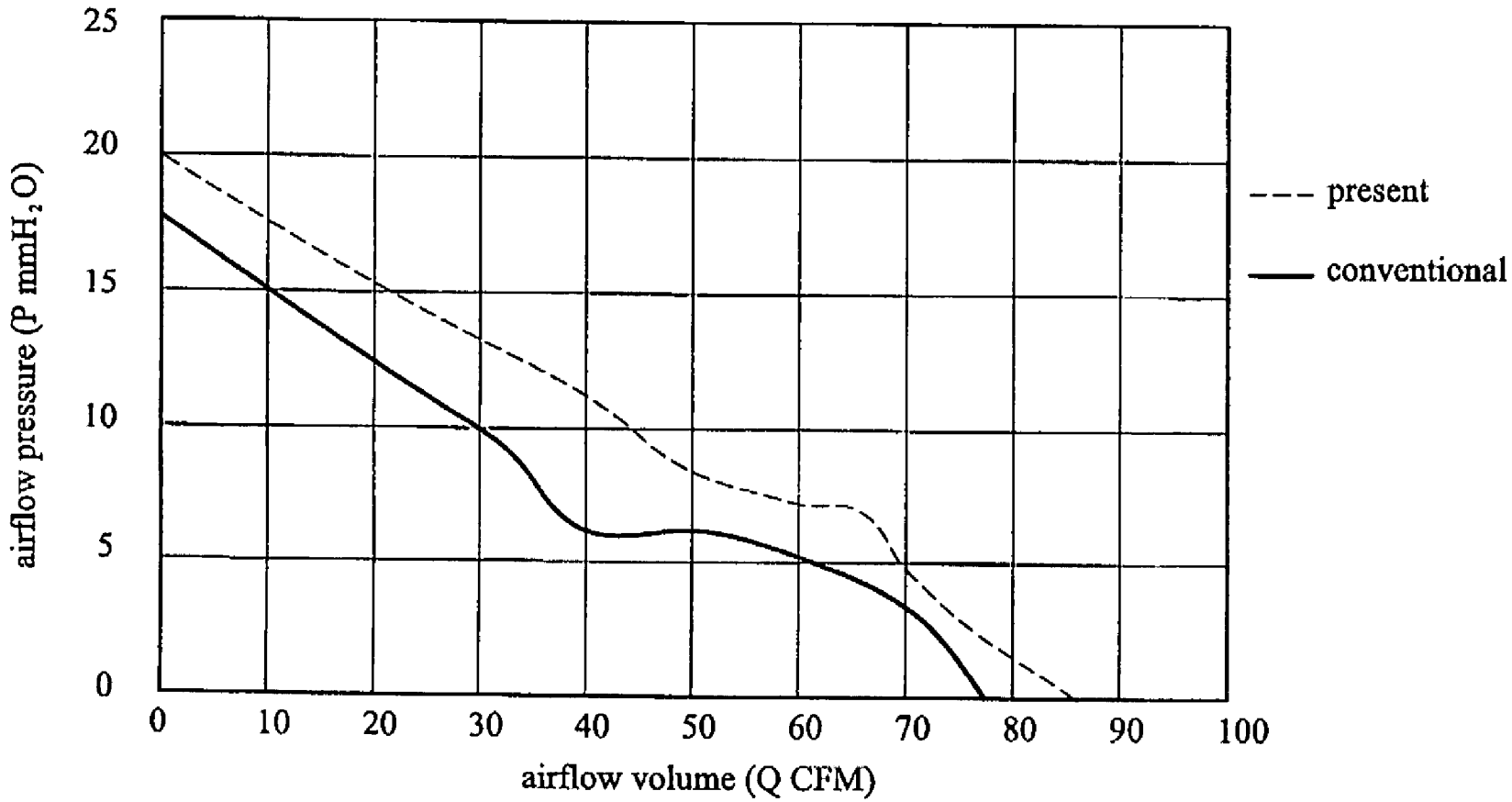
FIG. 7 is a diagram showing characteristic comparison of the conventional and present fans.

FIG. 7 is a diagram showing characteristic comparison of the conventional and present fans. Both the conventional and present fans have a diameter of approximate 8 cm and were tested at speed of 5700 rpm. As shown in FIG. 7, the present fan provides larger airflow pressure and volume compared to the conventional fan. Specifically, at an airflow volume of 40 CFM, the conventional fan provides an air pressure of 7.9 $mmH_2O$ while the present fan provides an air pressure of 12.9 $mmH_2O$. As the results, the pressure provided by the present fan is increased by 63% compared to the conventional fan. Alternatively, at an air pressure of 10 $mmH_2O$, the conventional fan provides an airflow volume of 28.8 CFM while the present fan provides an airflow volume of 45 CFM. As the results, the airflow volume provided by the present fan is increased by 56% compared to the conventional fan. Accordingly, the present fan effectively enhances the air pressure and volume and thus rectifies the airflow.

Figure 8:
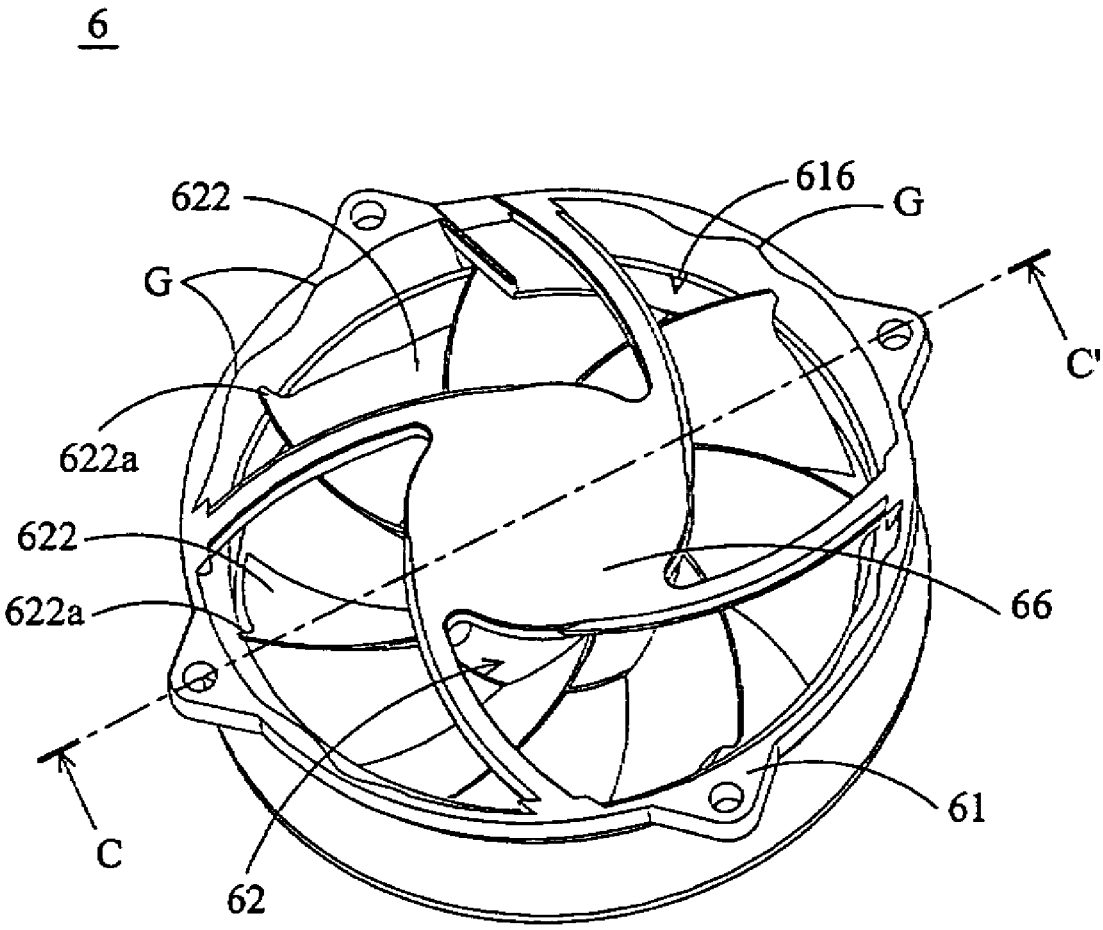
FIG. 8 is a schematic view of a fan (heat dissipation apparatus) of another embodiment of the invention.
Figure 9A:
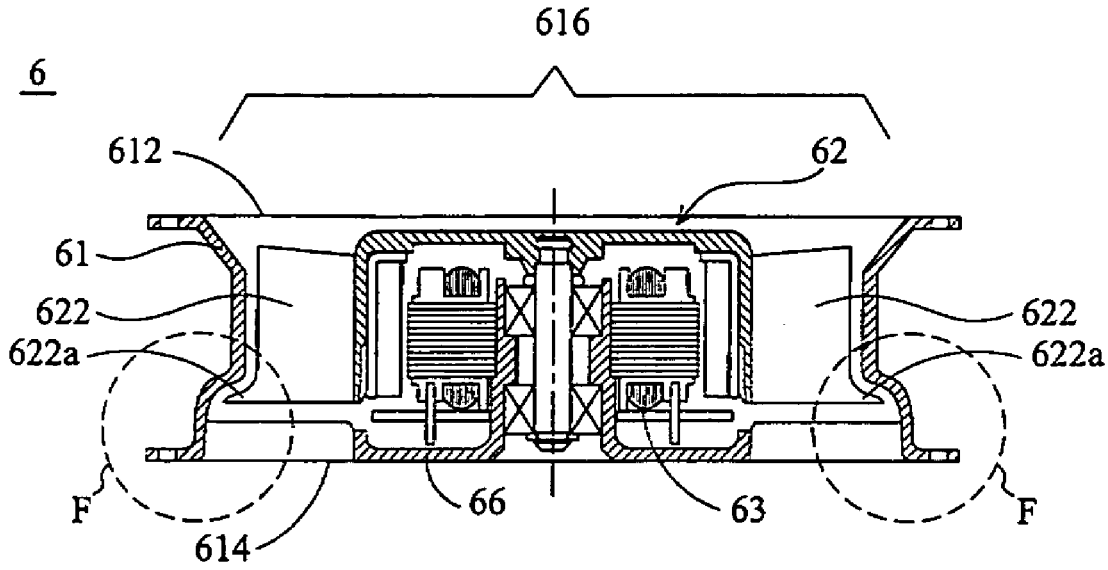
FIG. 9A is a schematic cross section taken along C-C' of FIG. 8.

Referring to FIG. 8 and FIG. 9A, another heat dissipation apparatus (fan) 6 can be, for example, an axial flow fan and comprises a fan frame 61, an impeller 62, and a motor base 66.

The fan frame 61 may be a substantially circular casing and comprises an air inlet 612, an air outlet 614, a passage 616, a curved expansion portion F, and multiple curved concaves G. The air inlet 612 is opposite the air outlet 614. The passage 616 is between the air inlet 612 and the air outlet 614, guiding airflow from the air inlet 612 to the air outlet 614. The curved expansion portion F is radially and outwardly extended from an inner peripheral wall of the passage 616 at the air inlet 612 or air outlet 614. In this embodiment, the curved expansion portion F is radially and outwardly extended from an inner peripheral wall of the passage 616 at the air outlet 614. The curved concaves G are formed in the curved expansion portion F, providing stabilization functions to the airflow. Namely, the pressure of the airflow in the passage 616 can be stabilized in the existence of the curved concaves G.

Figure 9B:
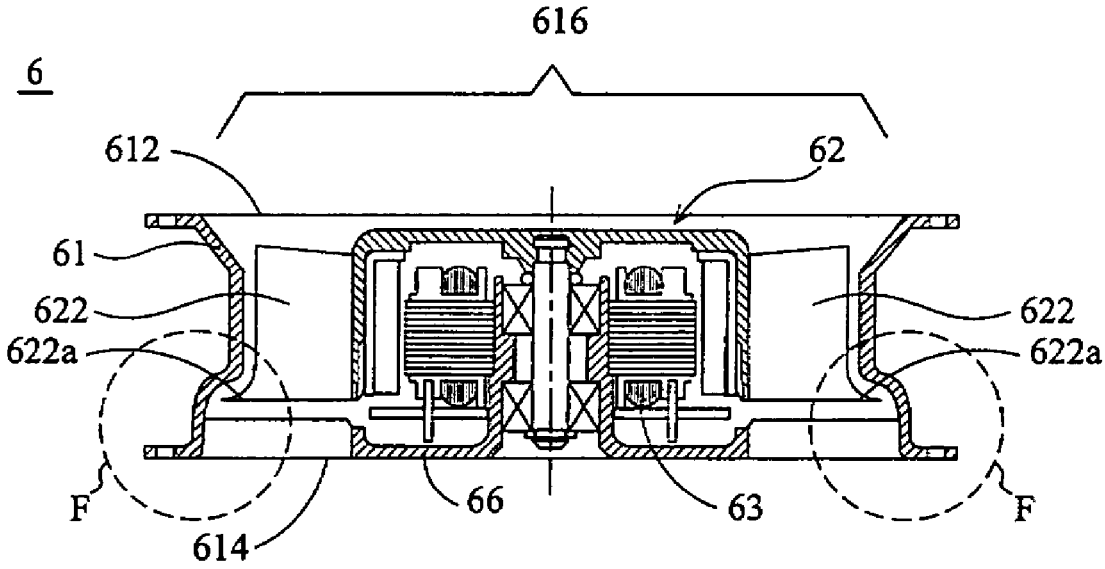
FIG. 9B is another schematic cross section taken along C-C' of FIG. 8.
Figure 9C:
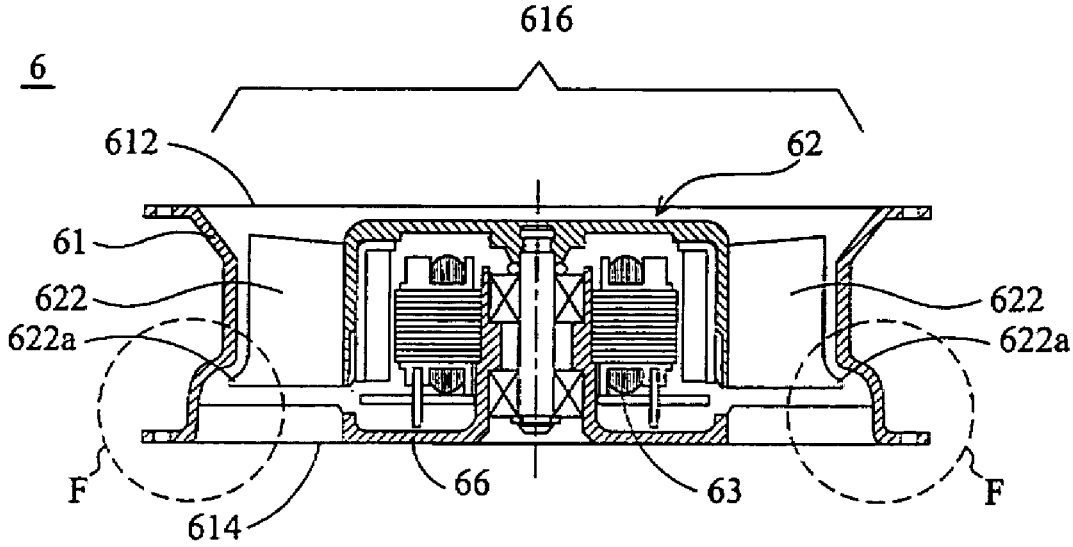
FIG. 9C is yet another schematic cross section taken along C-C' of FIG. 8.
Figure 9D:
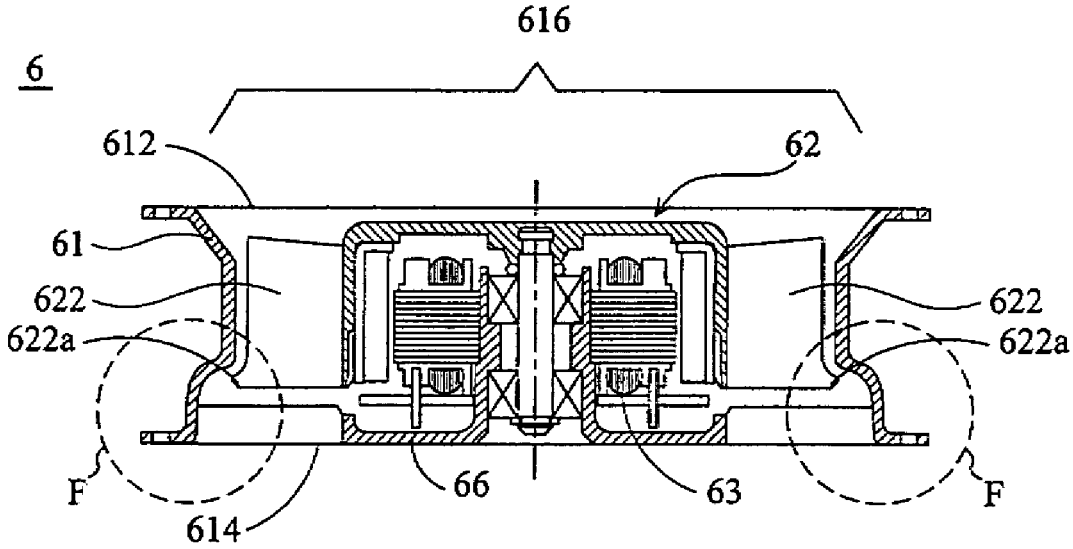
FIG. 9D is still another schematic cross section taken along C-C' of FIG. 8.

The impeller 62 is disposed in the fan frame 61 and comprises a plurality of blades 622. Each blade 622 is disposed in the passage 616 and comprises an extension end 622*a* extending to the curved expansion portion F. Specifically, the extension end 622*a* can increase airflow volume of the heat dissipation apparatus (fan) 6. Alternatively, the curvature of each extension end 622*a* corresponds to that of the curved expansion portion F, or the profile of each extension end 622*a* corresponds to that of the curved expansion portion F. Additionally, the extension end 622*a* may be configured with a curved angle (FIG. 9A), an acute angle (FIG. 9B), an obtuse angle (FIG. 9C), or a bevel angle (FIG. 9D).

The motor base 66 is disposed in the fan frame 61. The impeller 62 is disposed on the motor base 66.

Accordingly, when the heat dissipation apparatus (fan) 6 operates, a motor 63 disposed on the motor base 66 activates the impeller 62 so as to provide airflow to an electronic device (not shown) and dissipates the heat generated by the electronic device.

Moreover, the heat dissipation apparatus (fan) 6 may also be applied to the heat dissipation system 5 (as shown in FIG. 4) which includes the system housing 3 and multiple electronic devices. Accordingly, heat generated by the electronic devices is efficiently dissipated, and the electronic devices are thus prevented from damaging due to high temperature.

Figure 10:
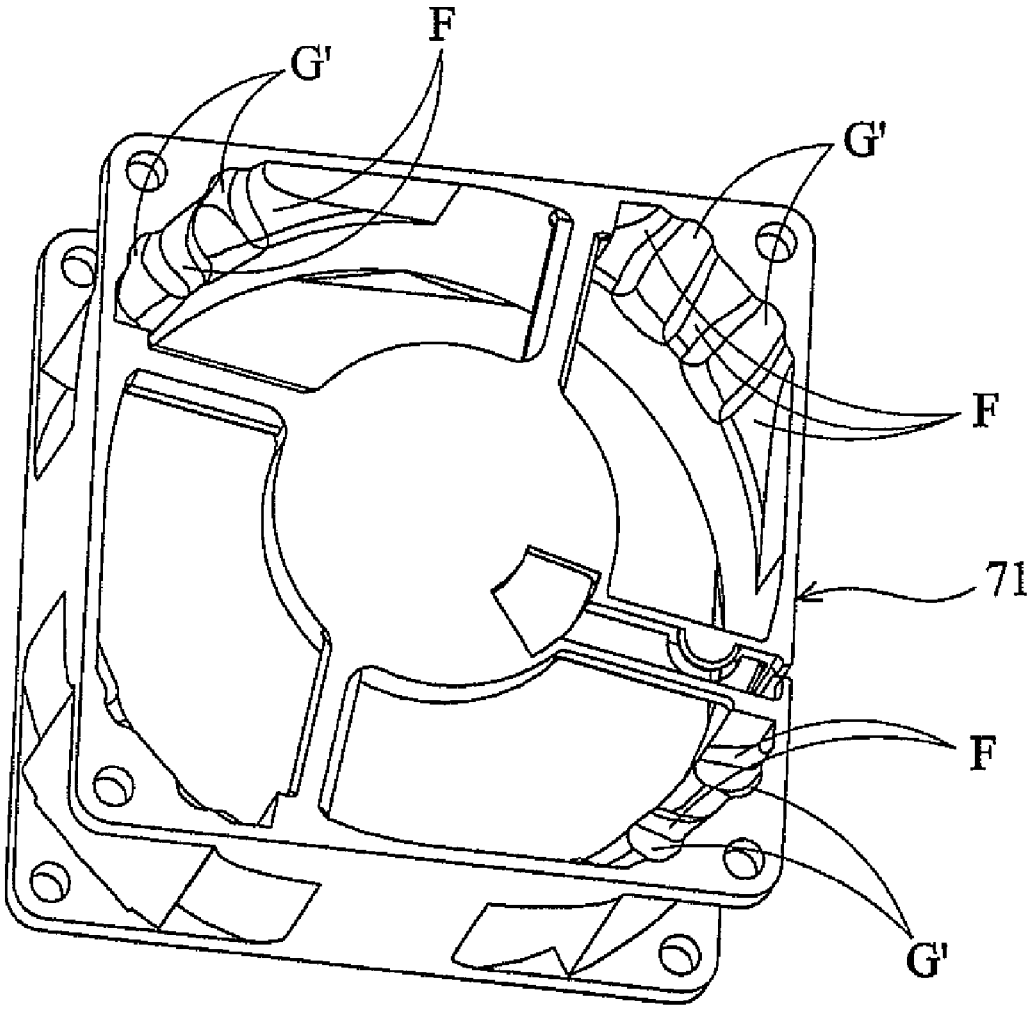
FIG. 10 is a schematic view of another fan frame of the invention.

Moreover, the fan frame 61 may not be a substantially circular casing. For example, as shown in FIG. 10, another fan frame 71 may be a substantially rectangular casing. Similarly, the fan frame 71 comprises multiple curved concaves G' formed in a curved expansion portion (not shown in FIG. 10), providing stabilization functions to the airflow.

In conclusion, the fans (heat dissipation apparatus) and fan frame of the present invention provide curved expansion portions capable of reducing noise from friction between airflow and the frame wall, thereby stabilizing the airflow, and thus enhancing performance of the fans. Moreover, without interfering with other heat dissipation devices originally disposed in the fans, the inner peripheral walls of the fan frames outwardly extend to increase the area through which the airflow passes, thereby enhancing heat dissipation of the fans. Further, the fan is easily applied to a heat dissipation system or any other electronic devices which generate heat by assembling without modifying arrangement of the system.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A heat dissipation apparatus, comprising:

a fan frame having an air inlet, an air outlet, a passage, and a curved expansion portion, wherein the air inlet is opposite the air outlet and the passage is between the air inlet and the air outlet, guiding airflow from the air inlet to the air outlet, and the curved expansion portion, having a recess in which the airflow forms an airflow layer, is radially and outwardly extended from an inner peripheral wall of the passage at one of the air inlet and the air outlet; and an impeller disposed in the fan frame and having a plurality of blades, wherein each blade is disposed in the passage and has an extension end extending to the curved expansion portion, wherein the fan frame further comprises at least one curved concave formed in the curved expansion portion to create a wavy outline of the curved expansion portion, providing stabilization functions to the airflow.

2. The heat dissipation apparatus as claimed in claim 1, wherein the profile of the extension end corresponds to that of the curved expansion portion.

3. The heat dissipation apparatus as claimed in claim 1, wherein the curvature of the extension end corresponds to that of the curved expansion portion.

4. The heat dissipation apparatus as claimed in claim 1, wherein the extension end is configured with a curved angle, an acute angle, an obtuse angle, or a bevel angle.

5. The heat dissipation apparatus as claimed in claim 1, wherein the recess stops subsequent airflow from directly contacting the inner peripheral wall of the passage.

6. The heat dissipation apparatus as claimed in claim 1, wherein the fan frame further comprises another curved expansion portion radially and outwardly extended from the inner peripheral wall of the passage at the other of the air inlet and the air outlet, and the other curved expansion portion is symmetrical to the curved expansion portion with respect to a central axis of the passage.

7. The heat dissipation apparatus as claimed in claim 1, further comprising a motor base disposed in the fan frame, wherein the impeller is disposed on the motor base, and the motor base comprises a slope radially inclined.

8. The heat dissipation apparatus as claimed in claim 7, wherein the slope is flat.

9. The heat dissipation apparatus as claimed in claim 1, wherein the profile of the extension end does not correspond to that of the curved expansion portion.

10. The heat dissipation apparatus as claimed in claim 1, wherein the curvature of the extension end does not correspond to that of the curved expansion portion.

11. A fan frame, comprising:

an air inlet;

an air outlet opposite the air inlet;

a passage between the air inlet and the air outlet, for guiding airflow from the air inlet to the air outlet;

a curved expansion portion radially and outwardly extended from an inner peripheral wall of the passage at one of the air inlet and the air outlet, wherein the curved expansion portion further comprises a recess in which the airflow forms an airflow layer, stopping subsequent airflow from directly contacting the inner peripheral wall of the passage; and at least one curved concave formed in the curved expansion portion to create wavy outline of the curved expansion portion.

12. The fan frame as claimed in claim 11, wherein the fan frame further comprises another curved expansion portion radially and outwardly extended from the inner peripheral wall of the passage at the other of the air inlet and the air outlet, and the other curved expansion portion is symmetrical to the curved expansion portion with respect to a central axis of the passage.

13. A heat dissipation system, comprising:

a system housing;

at least one electronic device disposed in the system housing; and a heat dissipation apparatus applied to the system housing for dissipating heat generated by the at least one electronic device, wherein the heat dissipation apparatus has a fan frame and an impeller, the fan frame has an air inlet, an air outlet, a passage, and a curved expansion portion, the air inlet is opposite the air outlet and the passage is between the air inlet and the air outlet, guiding airflow from the air inlet to the air outlet, the curved expansion portion has a recess in which the airflow forms an airflow layer and is radially and outwardly extended from an inner peripheral wall of the passage at the air inlet or air outlet, the impeller is disposed in the fan frame and has a plurality of blades, and each blade is disposed in the passage and has an extension end extending to the curved expansion portion, wherein the recess stops subsequent airflow from directly contacting the inner peripheral wall of the passage, and wherein the fan frame further comprises at least one curved concave formed in the curved expansion portion to create a wavy outline of the curved expansion portion, providing stabilization functions to the airflow.

14. The heat dissipation apparatus as claimed in claim 13, wherein the profile of the extension end correspond to that of the curved expansion portion.

15. The heat dissipation apparatus as claimed in claim 13, wherein the curvature of the extension end correspond to that of the curved expansion portion.

16. The heat dissipation apparatus as claimed in claim 13, wherein the profile of the extension end does not correspond to that of the curved expansion portion.

17. The heat dissipation apparatus as claimed in claim 13, wherein the curvature of the extension end does not correspond to that of the curved expansion portion.

* * * * *